US011135857B2

(12) United States Patent
Shibata et al.

(10) Patent No.: US 11,135,857 B2
(45) **Date of Patent: *Oct. 5, 2021**

(54) PARTIALLY DRIED INKJET MEDIA CONDITIONER

(71) Applicant: Hewlett-Packard Development Company, L.P., Spring, TX (US)

(72) Inventors: Alan Shibata, Vancouver, WA (US); Matthew Raisanen, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/935,578

(22) Filed: Jul. 22, 2020

(65) Prior Publication Data

US 2020/0346469 A1 Nov. 5, 2020

Related U.S. Application Data

(63) Continuation of application No. 16/326,040, filed as application No. PCT/US2016/050210 on Sep. 2, 2016, now Pat. No. 10,759,195.

(51) Int. Cl.
*B41J 11/00* (2006.01)
*B41M 7/00* (2006.01)

(52) U.S. Cl.
CPC ..... *B41J 11/002* (2013.01); *B41M 7/009* (2013.01); *B41M 7/0054* (2013.01)

(58) Field of Classification Search
CPC ..... B41J 11/002; B41M 7/009; B41M 7/0054
USPC ..... 347/101, 102, 104
See application file for complete search history.

(56) References Cited

U.S. PATENT DOCUMENTS

| | | | | |
|---|---|---|---|---|
| 5,672,018 | A | 9/1997 | Yamamoto et al. | |
| 5,787,331 | A | 7/1998 | Ohkuma et al. | |
| 5,895,156 | A | 4/1999 | Kabeta et al. | |
| 7,229,167 | B2 | 6/2007 | Miyamoto et al. | |
| 7,315,705 | B2 | 1/2008 | Yasui et al. | |
| 7,324,778 | B2 | 1/2008 | Suzuki et al. | |
| 8,544,386 | B2 | 10/2013 | Keyes et al. | |
| 8,721,064 | B2 | 5/2014 | Miyamoto et al. | |
| 9,242,456 | B2 | 1/2016 | Qi | |
| 10,479,110 | B2 * | 11/2019 | Rasmussen | B41J 11/0024 |
| 10,525,737 | B2 * | 1/2020 | Shibata | B41M 7/009 |
| 10,759,195 | B2 * | 9/2020 | Shibata | B41J 11/002 |
| 2002/0027587 | A1 | 3/2002 | Sugaya et al. | |
| 2002/0130939 | A1 | 9/2002 | Jacob | |

(Continued)

FOREIGN PATENT DOCUMENTS

| | | |
|---|---|---|
| JP | 2003276926 | 10/2003 |
| JP | 2007516865 | 6/2007 |
| JP | 2008120072 | 5/2008 |

OTHER PUBLICATIONS

Nam, W-S. et al., Curl Depending on Bending Moment and Drying Shrinkage, May 22, 2006, J. Ind. Eng. Chen., vol. 12 No. 4 (2006) ~ pp. 601-607.

*Primary Examiner* — An H Do
(74) *Attorney, Agent, or Firm* — Brooks Cameron & Huebsch PLLP

(57) ABSTRACT

A system for a partially dried inkjet media conditioner can include a heated pressure roller to apply pressure to a first side of partially dried inkjet media and apply heat to a second side of the partially dried inkjet media.

14 Claims, 5 Drawing Sheets

(56) References Cited

U.S. PATENT DOCUMENTS

| | | | |
|---|---|---|---|
| 2003/0137572 | A1 | 7/2003 | Miyamoto et al. |
| 2008/0252000 | A1 | 10/2008 | Dochi |
| 2013/0271542 | A1 | 10/2013 | Leighton |

* cited by examiner

PARTIALLY DRIED INKJET MEDIA CONDITIONER

PRIORITY INFORMATION

This application is a continuation of U.S. National Stage application Ser. No. 16/326,040 filed on Feb. 15, 2019, which claims priority to International Application No. PCT/US16/50210 filed on Sep. 2, 2016. The contents of which are incorporated herein by reference in its entirety.

BACKGROUND

Inkjet printers can deposit quantities of printing fluid onto a printable media (e.g., paper, plastic, etc.). In some examples, inkjet printers can create a curl and/or cockle in the printed media when the printing fluid droplets deposited by the inkjet printer are not completely dry. In some examples, a number of physical properties of the printable media can be changed when the printing fluid droplets deposited by the inkjet printer are not completely dry. For example, the stiffness of the printable media can be changed when the printing fluid droplets deposited by the inkjet printer are not completely dry. The curl, cockle, and/or other physical properties that change due to the printing fluid droplets can make finishing processes difficult.

DETAILED DESCRIPTION

Figure 1:
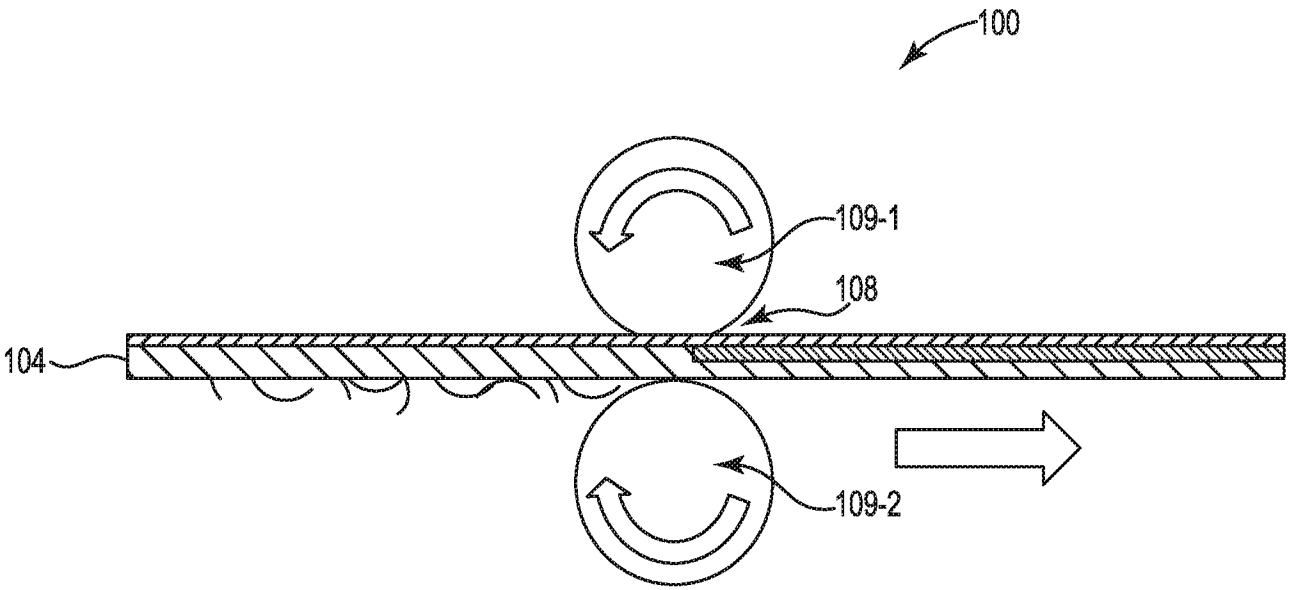
FIG. 1 illustrates an example system for a partially dried inkjet media conditioner consistent with the present disclosure.

A number of systems and devices for a partially dried inkjet media conditioner are described herein. In some examples, a partially dried inkjet media conditioner includes a heated pressure roller to apply pressure to a first side of partially dried inkjet media and apply heat to a second side of the partially dried inkjet media. As used herein, partially dried inkjet media can include media with applied printing fluid from an inkjet type printing device that is not completely dried on the media. The partially dried inkjet media conditioner can be utilized to increase evaporation of printing fluid applied to the partially dried inkjet media and remove or reduce distorted properties from the partially dried inkjet media.

The partially dried inkjet media can provide difficulties when stacking, aligning, and/or finishing. For example, the partially dried inkjet media can have distorted properties such as a curl, a cockle, a reduction in stiffness, increased surface roughness, extruding fibers from the surface, misaligned fibers, and/or increased sheet to sheet friction of the media. In some examples, these distorted properties can be caused by printing fluid deposited on the media and the media absorbing the printing fluid. For example, the printing fluid can be in a liquid state that can be absorbed by a media such as paper. In this example, the liquid state of the printing fluid can cause the distorted properties of the media in a similar way that other liquids may distort the properties of the media.

In some examples, the partially dried inkjet media conditioner can be utilized to increase evaporation of printing fluid applied to the partially dried inkjet media. In some examples, the partially dried inkjet media conditioner can remove or reduce the distorted properties generated by the printing fluid applied to the partially dried inkjet media. For example, the partially dried inkjet media can include extruding fibers from the surface that can be embedded into the surface of the partially dried inkjet media by the pressure and heat applied by the partially dried inkjet media. In some examples, the partially dried inkjet media conditioner can include a heated pressure roller. In some examples, the heated pressure roller can include a pressure roller to apply pressure to a first side of the partially dried inkjet media and a heated roller to apply heat to a second side of the partially dried inkjet media.

In some examples, the partially dried inkjet media conditioner can utilize a plurality of heated pressure rollers. In some examples, the plurality of heated pressure rollers can be utilized to apply heat and pressure to the first side of the partially dried inkjet media and apply heat and pressure to the second side of the partially dried inkjet media. In some examples, the plurality of heated pressure rollers can also be utilized to apply tension to the partially dried inkjet media as described herein. In some examples, the applied heat, pressure, and tension can remove or reduce the distorted properties from the partially dried inkjet media.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

FIG. 1 illustrates an example system 100 for a partially dried inkjet media conditioner consistent with the present disclosure. In some examples, the system 100 can be positioned within an inkjet printer to receive partially dried inkjet media 104 from a print zone. As used herein, the print zone includes an area within a print engine of an inkjet printer to deposit printing fluid on a print media (e.g., paper, plastic, etc.). In some examples, the print zone can include a plurality of inkjet heads that can deposit a printing fluid on the print media to generate an image on the print media. As described herein, the printing fluid deposited on the print media can generate partially dried inkjet media 104 that includes a number of distorted properties.

In some examples, the system 100 can include a conditioner 108 to receive the partially dried inkjet media 104. In some examples, the conditioner 108 can include a first roller 109-1 and a second roller 109-2. In some examples, the first roller 109-1 can receive a first side of the partially dried inkjet media. For example, the first roller 109-1 can receive a top side of the partially dried inkjet media as illustrated in FIG. 1. In some examples, the second roller 109-2 can receive a second side of the partially dried inkjet media 104.

For example, the second roller 109-2 can receive a bottom side of the partially dried inkjet media 104 as illustrated in FIG. 1.

In some examples, the conditioner 108 can be a heated pressure roller. As used herein, a heated pressure roller can apply pressure to a first side of the partially dried inkjet media 104 and apply heat to a second side of the partially dried inkjet media 104. In some examples, one of the first roller 109-1 and second roller 109-2 can be a pressure roller and the opposite roller can be a heated roller. For example, the first roller 109-1 can be a pressure roller and the second roller 109-2 can be a heated roller. In another example, the first roller 109-1 can be a heated roller and the second roller 109-2 can be a pressure roller. As used herein, a pressure roller can be a roller utilized to apply pressure to a side of the partially dried inkjet media 104 and a heated roller can be a roller utilized to apply heat to a side of the partially dried inkjet media 104.

In some examples, the partially dried inkjet media 104 can include a moisture level that is above a threshold moisture level. In some examples, the conditioner 108 can remove a greater portion of distorted features of the partially dried inkjet media 104 when the moisture level of the partially dried inkjet media is above the threshold moisture level. For example, the conditioner 108 can be utilized to reform the partially dried inkjet media 104 to remove or reduce the distorted features as described herein. In some examples, the partially dried inkjet media 104 may not reform and/or may not remove as many distorted features when the moisture level of the partially dried inkjet media 104 is below the threshold moisture level. As used herein, reforming includes realigning a number of fibers of the partially dried inkjet media 104.

The system 100 can provide a greater removal of distorted features of the partially dried inkjet media 104 compared to previous systems and methods. For example, the system 100 can utilize a conditioner 108 that utilizes a heated pressure roller that increases evaporation of the printing fluid applied to the partially dried inkjet media 104. In some examples, the conditioner 108 can reform many of the properties of the partially dried inkjet media 104, which can remove or reduce the distorted properties of the partially dried inkjet media 104 caused by deposited printing fluid.

Figure 2:
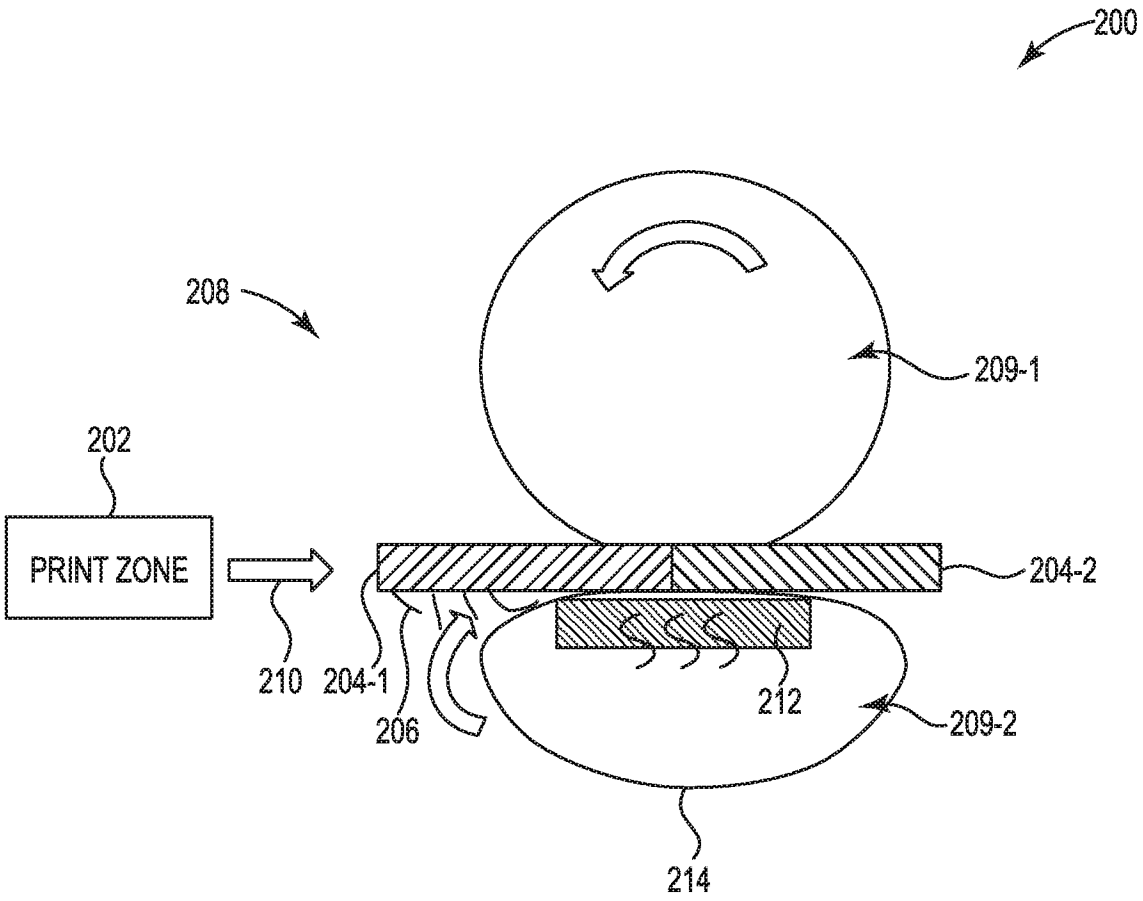
FIG. 2 illustrates an example system for a partially dried inkjet media conditioner consistent with the present disclosure.

FIG. 2 illustrates an example system 200 for a partially dried inkjet media conditioner consistent with the present disclosure. In some examples, the system 200 can include similar elements as system 100 as referenced in FIG. 1. In some examples, the system 200 can include a print zone 202 to deposit printing fluid on print media to generate partially dried inkjet media 204. In some examples, the partially dried inkjet media can move from the print zone 202 to a conditioner 208 in the direction of arrow 210.

In some examples, the partially dried inkjet media 204-1 can include distorted properties 206. In some examples, the distorted properties 206 can include raised fibers from the surface of the partially dried inkjet media 204-1. In some examples, the distorted properties 206 can provide difficulties when stacking, aligning, and/or finishing. In some examples, the conditioner 208 can be utilized to remove or reduce the distorted properties 206 from the partially dried inkjet media 204-1 to generate partially dried inkjet media 204-2 with fewer or no distorted properties. In some examples, the conditioner 208 can include a heated pressure roller as described herein to apply pressure and heat to the partially dried inkjet media 204-1.

In some examples, the partially dried inkjet media 204-1 can be provided to the conditioner 208 with a printed side (e.g., side with printing fluid deposited) or most recently printed side (e.g., second side deposited with printing fluid of a duplex print job) of the partially dried inkjet media 204-1 received by a second roller 209-2. For example, a printed side of the media can include a greater quantity of distorted properties 206. In this example, the printed side and/or a most recently printed side of the partially dried inkjet media 204-1 can be received by the second roller 209-2 when the second roller 209-2 is a heated roller. In this example, a side of the partially dried inkjet media 204-1 with a greater quantity of distorted properties 206 can be provided to a heated roller of a heated pressure roller to increase evaporation of the printing fluid applied to the partially dried inkjet media 204-1.

In some examples, the conditioner 208 can include a first roller 209-1 and a second roller 209-2. In some examples, the first roller 209-1 can be a pressure roller to apply pressure on a first side of the partially dried inkjet media 204-1. In some examples, the first roller 209-1 can apply pressure on a top side of the partially dried inkjet media 204-1 as illustrated in FIG. 2. In some examples, the second roller 209-2 can be a heated roller to apply heat to a second side of the partially dried inkjet media 204-2. In some examples, the second roller 209-2 can apply heat to a bottom side of the partially dried inkjet media 204-1 as illustrated in FIG. 2.

In some examples, the first roller 209-1 can be a roller that applies pressure to the partially dried inkjet media 204-1 by applying a force in a direction of the second roller 209-2. In some examples, the first roller 209-1 can apply the force and/or pressure to the partially dried inkjet media 204-1 with a number of springs and/or actuators that maintains a force or pressure on the partially dried inkjet media 204-1 as it passes between the first roller 209-1 and the second roller 209-2. In some examples, the first roller 209-1 can move in a counter clockwise direction to move the partially dried inkjet media 204-1 in the direction of arrow 210.

In some examples, the speed of the first roller 209-1 can be altered to alter a speed of the partially dried inkjet media 204-1 passing through the conditioner 208. In some examples, the speed of the first roller 209-1 can be altered based on a moisture level of the partially dried inkjet media 204-1 and/or a severity of the distorted properties as described herein. For example, the speed of the first roller 209-1 can be altered to a relatively slower speed when the moisture level is above a threshold moisture level (e.g., relatively higher moisture level, etc.). In some examples, the moisture level of the partially dried inkjet media 204-1 can correspond to a severity of the distorted properties. For example, a relatively higher moisture level can correspond to a relatively high severity of distorted properties.

In some examples, the first roller 209-1 can be a pressure roller that can be adjusted to alter a pressure applied to the partially dried inkjet media 204-1. In some examples, the pressure can be altered based on a moisture level of the partially dried inkjet media 204-1. For example, the pressure of the first roller 209-1 can be altered to a relatively greater pressure when the partially dried inkjet media 204-1 is above a threshold moisture level and can be altered to a relatively lower pressure when the partially dried inkjet media 204-1 is below the threshold moisture level.

In some examples, the second roller 209-2 can be a heated roller to apply heat to a second side of the partially dried inkjet media 204-1. In some examples, the second roller 209-2 can be solid roller with an integrated heat source. In some examples, the second roller 209-2 can be a belt heated roller that includes a belt 214 that transfers heat from a heat source 212 to a second side of the partially dried inkjet media 204-1. For example, the second roller 209-2 can include a heat source 212 such as a halogen heat source. In this example, the halogen heat source can transfer heat to a belt 214 that can rotate in a clockwise direction to move the partially dried inkjet media 204-1 in the direction of arrow 210. In some examples, the heat transferred to the belt 214 can be transferred to a second side of the partially dried inkjet media 204-1. For example, the belt 214 can transfer heat to a bottom side of the partially dried inkjet media 204-1 as illustrated in FIG. 2.

In some examples, the heat source 212 can be adjusted to apply different quantities of heat to the belt 214 and/or the second side of the partially dried inkjet media 204-1. In some examples, the heat source 212 can be adjusted based on a moisture level of the partially dried inkjet media 204-1. For example, a greater quantity of heat can be applied to the partially dried inkjet media 204-1 when the moisture level of the partially dried inkjet media 204-1 is greater than a threshold moisture level and a lower quantity of heat can be applied to the partially dried inkjet media 204-1 when the moisture level of the partially dried inkjet media 204-1 is less than a threshold moisture level.

The system 200 can be provide a greater removal of distorted features of the partially dried inkjet media 204-1, 204-2 compared to previous systems and methods. For example, the system 200 can utilize a conditioner 208 that utilizes a heated pressure roller that increases evaporation of the printing fluid applied to the partially dried inkjet media 204-1, 204-2. In some examples, the conditioner 208 can reform many of the properties of the partially dried inkjet media 204-1, 204-2, which can remove or reduce the distorted properties of the partially dried inkjet media 204-1, 204-2 caused by deposited printing fluid.

Figure 3:
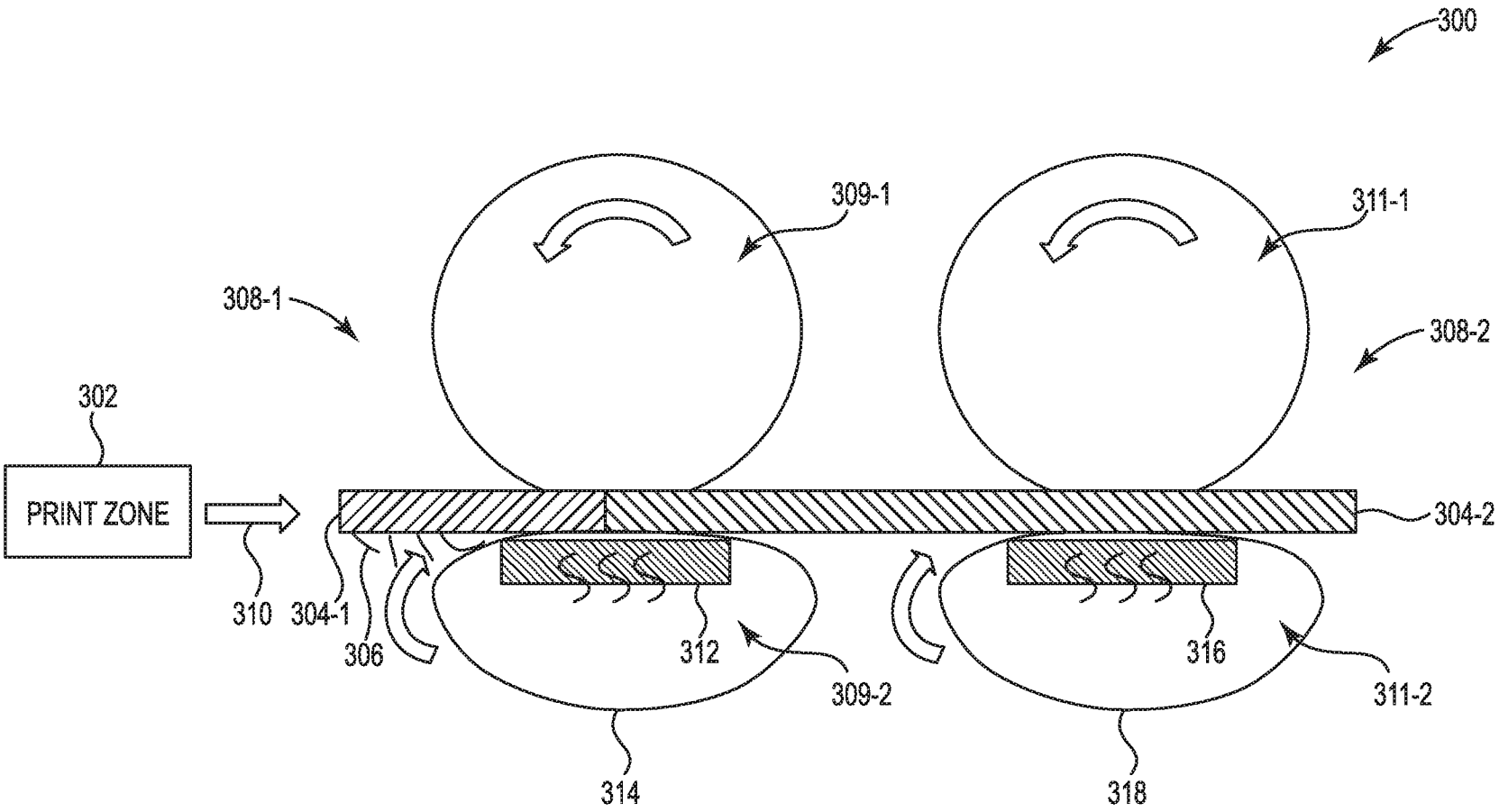
FIG. 3 illustrates an example system for a partially dried inkjet media conditioner consistent with the present disclosure.

FIG. 3 illustrates an example system 300 for a partially dried inkjet media conditioner consistent with the present disclosure. In some examples, the system 300 can include similar elements as system 100 as referenced in FIG. 1 and/or system 200 as referenced in FIG. 2. For example, system 300 can include a print zone 302 that can deposit printing fluid on a print media to generate partially dried inkjet media 304-1, 304-2. In some examples, the partially dried inkjet media 304-1 can include distorted properties 306 as described herein.

In some examples, the partially dried inkjet media 304-1 can move through a first conditioner 308-1 and a second conditioner 308-2 in the direction of arrow 310. In some examples, the first conditioner 308-1 can include a first heated pressure roller and the second conditioner 308-2 can include a second heated pressure roller. In some examples, the first conditioner 308-1 can include a first roller 309-1 that is a pressure roller to apply pressure to the first side of the partially dried inkjet media 304-1 as described herein. In some examples, the first conditioner 308-1 can include a second roller 309-2 that includes a heat source 312 and a belt 314 to apply heat to a second side of the partially dried inkjet media 304-1. In some examples, the second conditioner 308-2 can include a first roller 311-1 that is a pressure roller to apply pressure to the first side of the partially dried inkjet media 304-1 as described herein. In some examples, the second conditioner 308-2 can include a second roller 311-2 that is a heated roller that includes a heat source 316 and a belt 318 to apply heat to the second side of the partially dried inkjet media 304-1 as described herein.

In some examples, the first conditioner 308-1 and the second conditioner 308-1 can have the same orientation. For example, the first conditioner 308-1 can include a first roller 309-1 to receive a first side of the partially dried inkjet media 304-1 and a second roller 309-2 to receive a second side of the partially dried inkjet media 304-1. In this example, the first roller 309-1 can be a pressure roller as described herein and the second roller 309-2 can be a heated roller as described herein. In this example, the second conditioner 308-2 can include a first roller 311-1 to receive the first side of the partially dried inkjet media 304-1 and a second roller 311-2 to receive the second side of the partially dried inkjet media 304-1. In this example, the first roller 311-1 can be a pressure roller as described herein and the second roller 311-2 can be a heated roller as described herein.

In some examples, a speed of the first conditioner 308-1 and/or a speed of the second conditioner 308-2 can be altered as described herein. In some examples, the speed of the first conditioner 308-1 and/or the speed of the second conditioner 308-2 can be altered to apply tension on the partially dried inkjet media 304-1. For example, the first conditioner 308-1 can be altered to a first speed and the second conditioner 308-2 can be altered to a second speed. In some examples, the first speed and the second speed can be different to apply the tension on the partially dried inkjet media 304-1. For example, the first speed can be relatively slower than the second speed to apply tension on the partially dried inkjet media 304-1 in the direction of arrow 310. In some examples, additional rollers can be added to the system to apply the tension described herein. For example, a roller can be positioned between the print zone 302 and the first conditioner 308-1 to apply tension on the partially dried inkjet media 304-1 between the print zone 302 and the first conditioner 308-1. In some examples, the tension can realign misaligned fibers of the partially dried inkjet media 304-1 as described herein.

The system 300 can be provide a greater removal of distorted features of the partially dried inkjet media 304-1, 304-2 compared to previous systems and methods. For example, the system 300 can utilize a plurality of conditioners 308-1, 308-2 that each utilize a heated pressure roller to increase evaporation of the printing fluid applied to the partially dried inkjet media 304-1, 304-2. In some examples, the conditioners 308-1, 308-2 can reform many of the properties of the partially dried inkjet media 304-1, 304-2 by applying heat, pressure, and/or tension on the partially dried inkjet media 304-1, which can remove or reduce the distorted properties of the partially dried inkjet media 304-1, 304-2 caused by deposited printing fluid.

Figure 4:
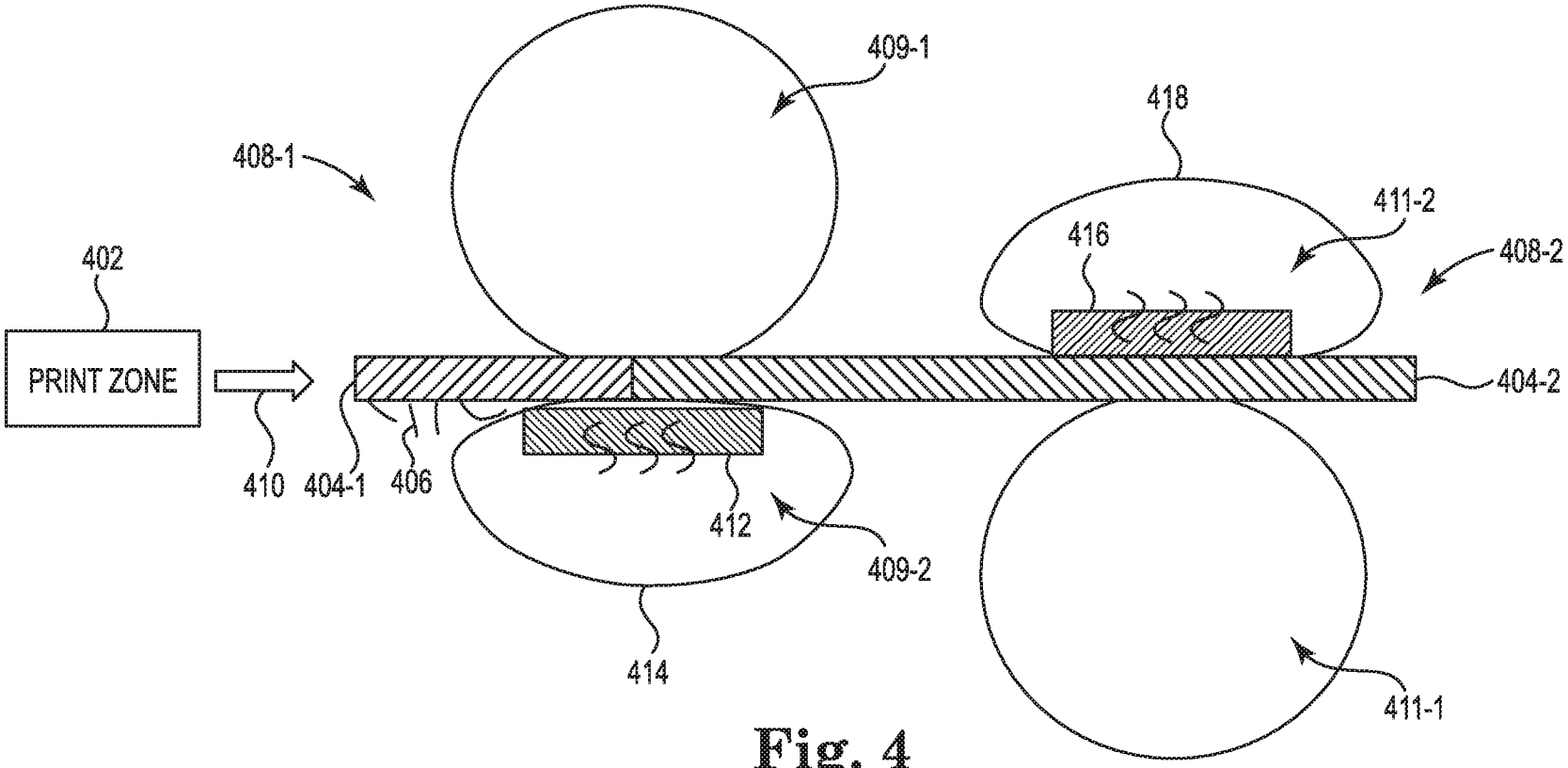
FIG. 4 illustrates an example system for a partially dried inkjet media conditioner consistent with the present disclosure.

FIG. 4 illustrates an example system 400 for a partially dried inkjet media conditioner consistent with the present disclosure. In some examples, the system 400 can include similar elements as system 100 as referenced in FIG. 1, system 200 as referenced in FIG. 2, and/or system 300 as referenced in FIG. 3. For example, system 400 can include a print zone 402 that can deposit printing fluid on a print media to generate partially dried inkjet media 404-1, 404-2. In some examples, the partially dried inkjet media 404-1 can include distorted properties 406 as described herein.

In some examples, the partially dried inkjet media 404-1 can move through a first conditioner 408-1 and a second conditioner 408-2 in the direction of arrow 410. In some examples, the first conditioner 408-1 can include a first heated pressure roller and the second conditioner 408-2 can include a second heated pressure roller. In some examples, the first conditioner 408-1 can include a first roller 409-1 that is a pressure roller to apply pressure to a first side of the partially dried inkjet media 404-1 as described herein. In some examples, the first conditioner 408-1 can include a second roller 409-2 that includes a heat source 412 and a belt 414 to apply heat to a second side of the partially dried inkjet media 404-1. In some examples, the second conditioner 408-2 can include a first roller 411-1 that is a pressure roller to apply pressure to the second side of the partially dried inkjet media 404-1 as described herein. In some examples, the second conditioner 408-2 can include a second roller 411-2 that is a heated roller that includes a heat source 416 and a belt 418 to apply heat to the first side of the partially dried inkjet media 404-1 as described herein. In these examples, a first heated roller (e.g., second roller 409-2) to apply heat to a second side of the partially dried inkjet media 404-1 and a second heated roller (e.g., second roller 411-2) to apply heat a first side of the partially dried inkjet media 404-1. In this way, heat can be evenly distributed on the first side and the second side of the partially dried inkjet media 404-1.

In some examples, the first conditioner 408-1 and the second conditioner 408-1 can have an opposite orientation. For example, the first conditioner 408-1 can include a first roller 409-1 to receive a first side of the partially dried inkjet media 404-1 and a second roller 409-2 to receive a second side of the partially dried inkjet media 404-1. In this example, the first roller 409-1 can be a pressure roller as described herein and the second roller 409-2 can be a heated roller as described herein. In this example, the second conditioner 408-2 can include a first roller 411-1 to receive the second side of the partially dried inkjet media 404-1 and a second roller 411-2 to receive the first side of the partially dried inkjet media 404-1. In this example, the first roller 411-1 can be a pressure roller as described herein and the second roller 411-2 can be a heated roller as described herein.

In some examples, a speed of the first conditioner 408-1 and/or a speed of the second conditioner 408-2 can be altered as described herein. In some examples, the speed of the first conditioner 408-1 and/or the speed of the second conditioner 408-2 can be altered to apply tension on the partially dried inkjet media 404-1. For example, the first conditioner 408-1 can be altered to a first speed and the second conditioner 408-2 can be altered to a second speed. In some examples, the first speed and the second speed can be different to apply the tension on the partially dried inkjet media 404-1. For example, the first speed can be relatively slower than the second speed to apply tension on the partially dried inkjet media 404-1 in the direction of arrow 410. In some examples, additional rollers can be added to the system to apply the tension described herein. For example, a roller can be positioned between the print zone 402 and the first conditioner 408-1 to apply tension on the partially dried inkjet media 404-1 between the print zone 402 and the first conditioner 408-1.

The system 400 can be provide a greater removal of distorted features of the partially dried inkjet media 404-1, 404-2 compared to previous systems and methods. For example, the system 400 can utilize a plurality of conditioners 408-1, 408-2 that each utilize a heated pressure roller to increase evaporation of the printing fluid applied to the partially dried inkjet media 404-1, 404-2. In some examples, the conditioners 408-1, 408-2 can reform many of the properties of the partially dried inkjet media 404-1, 404-2 by applying heat, pressure, and/or tension on the partially dried inkjet media 404-1, which can remove or reduce the distorted properties of the partially dried inkjet media 404-1, 404-2 caused by deposited printing fluid.

Figure 5:
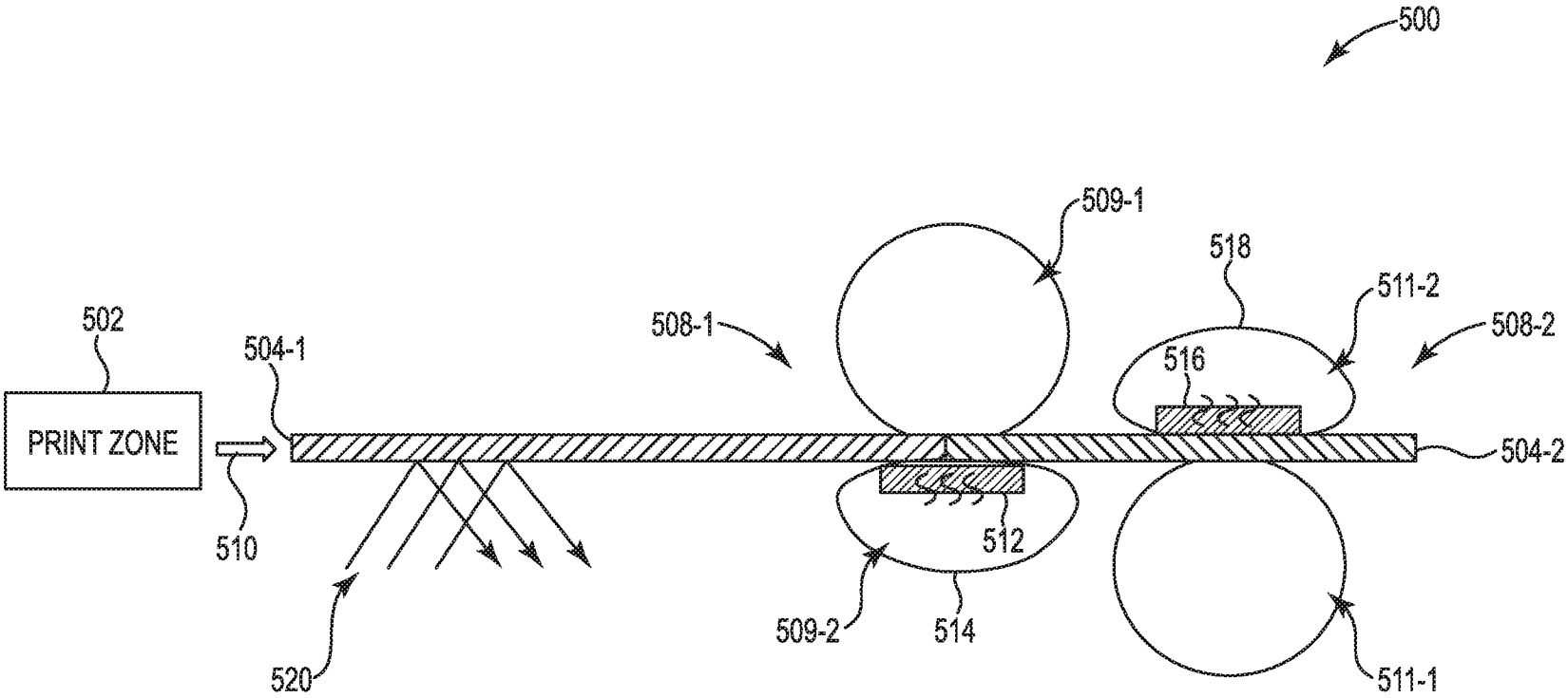
FIG. 5 illustrates an example system for a partially dried inkjet media conditioner with the present disclosure.

FIG. 5 illustrates an example system for a partially dried inkjet media conditioner with the present disclosure. In some examples, the system 500 can include similar elements as system 100 as referenced in FIG. 1, system 200 as referenced in FIG. 2, system 300 as referenced in FIG. 3, and/or system 400 as referenced in FIG. 4. For example, system 500 can include a print zone 502 that can deposit printing fluid on a print media to generate partially dried inkjet media 504-1, 504-2. In some examples, the partially dried inkjet media 504-1 can include distorted properties as described herein.

In some examples, the system 500 can include a dryer zone 520 that can apply heat and/or air to the partially dried inkjet media 504-1. In some examples, the dryer zone 520 can be coupled between the print zone 502 and a first conditioner 508-1. In some examples, the dryer zone 520 can be utilized to lower a moisture level of the partially dried inkjet media 504-1 prior to being received by the first conditioner 508-1. In some examples, the dryer zone 520 can be utilized to lower the moisture level of the partially dried inkjet media 504-1 below a first threshold. In some examples, the dryer zone 520 can be coupled between the print zone 502 and the conditioner 508-1 or first heated pressure roller to affix an image to the partially dried inkjet media 504-1 generated by the printing fluid. For example, the dryer zone 520 can affix or set the image generated by the printing fluid such that the conditioner 508-1 does not distort the image generated by the printing fluid.

In some examples, the dryer zone 520 can be prevented from lowering the moisture level of the partially dried inkjet media below a second threshold. For example, the system 500 can be utilized to reform the partially dried inkjet media 504-1 when the moisture level of the partially dried inkjet media 504-1 is between the first threshold and the second threshold. For example, a moisture level between the first threshold and the second threshold can allow the partially dried inkjet media 504-1 to be reformed by the first conditioner 508-1 and/or the second conditioner 508-2 as described herein.

In some examples, the dryer zone 520 can be utilized to apply heat to a second side of the partially dried inkjet media 504-1 to increase evaporation of the printing fluid applied to the partially dried inkjet media 504-1 by the print zone 502. In some examples, the quantity of heat applied by the dryer zone 520 can be based on a moisture level of the partially dried inkjet media 504-1. For example, the quantity of heat can be increased when the moisture level is above the first threshold moisture level and the quantity of heat can be decreased when the moisture level is between the first threshold moisture level and the second threshold moisture level. As described herein, a moisture level between the first threshold moisture level and the second threshold moisture level can allow the first conditioner 508-1 and/or the second conditioner 508-2 to reform the partially dried inkjet media, which can remove or reduce the distorted properties from the partially dried inkjet media 504-1.

In some examples, the partially dried inkjet media 504-1 can move through an input of a first conditioner 508-1 and an input of a second conditioner 508-2 coupled to the output of the first conditioner 508-1 in the direction of arrow 510. In some examples, the first conditioner 508-1 can include a first heated pressure roller and the second conditioner 508-2 can include a second heated pressure roller. In some examples, the first conditioner 508-1 can include a first roller 509-1 that is a pressure roller to apply pressure to a first side of the partially dried inkjet media 504-1 as described herein. In some examples, the first conditioner 508-1 can include a second roller 509-2 that includes a heat source 512 and a belt 514 to apply heat to a second side of the partially dried inkjet media 504-1. In some examples, the second conditioner 508-2 can include a first roller 511-1 that is a pressure roller to apply pressure to the second side of the partially dried inkjet media 504-1 as described herein. In some examples, the second conditioner 508-2 can include a second roller 511-2 that is a heated roller that includes a heat source 516 and a belt 518 to apply heat to the first side of the partially dried inkjet media 504-1 as described herein. In these examples, a first heated roller (e.g., second roller 509-2) to apply heat to a second side of the partially dried inkjet media 504-1 and a second heated roller (e.g., second roller 511-2) to apply heat a first side of the partially dried inkjet media 504-1. In this way, heat can be evenly distributed on the first side and the second side of the partially dried inkjet media 504-1.

In some examples, the first conditioner 508-1 and the second conditioner 508-1 can have an opposite orientation. For example, the first conditioner 508-1 can include a first roller 509-1 to receive a first side of the partially dried inkjet media 504-1 and a second roller 509-2 to receive a second side of the partially dried inkjet media 504-1. In this example, the first roller 509-1 can be a pressure roller as described herein and the second roller 509-2 can be a heated roller as described herein. In this example, the second conditioner 508-2 can include a first roller 511-1 to receive the second side of the partially dried inkjet media 504-1 and a second roller 511-2 to receive the first side of the partially dried inkjet media 504-1. In this example, the first roller 511-1 can be a pressure roller as described herein and the second roller 511-2 can be a heated roller as described herein.

In some examples, a speed of the first conditioner 508-1 and/or a speed of the second conditioner 508-2 can be altered as described herein. In some examples, the speed of the first conditioner 508-1 and/or the speed of the second conditioner 508-2 can be altered to apply tension on the partially dried inkjet media 504-1. For example, the first conditioner 508-1 can be altered to a first speed and the second conditioner 508-2 can be altered to a second speed. In some examples, the first speed and the second speed can be different to apply the tension on the partially dried inkjet media 504-1. For example, the first speed can be relatively slower than the second speed to apply tension on the partially dried inkjet media 504-1 in the direction of arrow 510. In some examples, additional rollers can be added to the system to apply the tension described herein. For example, a roller can be positioned between the print zone 502 and the first conditioner 508-1 to apply tension on the partially dried inkjet media 504-1 between the print zone 502 and the first conditioner 508-1.

The system 500 can be provide a greater removal of distorted features of the partially dried inkjet media 504-1, 504-2 compared to previous systems and methods. For example, the system 500 can utilize a plurality of conditioners 508-1, 508-2 that each utilize a heated pressure roller to increase evaporation of the printing fluid applied to the partially dried inkjet media 504-1, 504-2. In some examples, the conditioners 508-1, 508-2 can reform many of the properties of the partially dried inkjet media 504-1, 504-2 by applying heat, pressure, and/or tension on the partially dried inkjet media 504-1, which can remove or reduce the distorted properties of the partially dried inkjet media 504-1, 504-2 caused by deposited printing fluid.

The above specification, examples and data provide a description of the method and applications, and use of the system and method of the present disclosure. As used herein, "a number of" something can refer to a single element or a plurality of elements. For example, a number of distorted properties can include a single distorted property or a plurality of distorted properties. Since many examples can be made without departing from the spirit and scope of the system and method of the present disclosure, this specification merely sets forth some of the many possible example configurations and implementations.

What is claimed:

1. A media conditioner, comprising:

a first roller to apply pressure to a first side of print media and a second roller to apply heat to a second side of print media, wherein the print media includes a moisture level that is above a threshold moisture level from printing fluid deposited on the print media and wherein a speed of the media conditioner is altered based on the moisture level of the print media received from a dryer zone.

2. The media conditioner of claim 1, wherein the first roller and the second roller are utilized together as a heated pressure roller.

3. The media conditioner of claim 1, wherein the moisture level of the print media corresponds to a quantity of distorted properties of the print media.

4. The media conditioner of claim 1, wherein the print media is provided to the media conditioner such that a printed side of the print media is directed toward the second roller when the second roller is a heated roller.

5. The media conditioner of claim 4, wherein the printed side of the print media includes a greater quantity of distorted properties than a non-printed side of the print media.

6. A system for a partially dried inkjet media conditioner, comprising:

an inkjet print zone to deposit printing fluid on a media to generate partially dried inkjet media that includes a moisture level, wherein the partially dried inkjet media comprises a distorted property generated by the printing fluid;

a dryer zone to receive the partially dried inkjet media from the inkjet print zone, wherein the dryer zone lowers the moisture level below a first moisture threshold level; and a conditioner to receive the partially dried inkjet media from the dryer zone and to lower the moisture level below a second moisture threshold level, wherein the conditioner includes a first roller to apply pressure on the partially dried inkjet media and a second roller to apply heat on the partially dried inkjet media and wherein the pressure applied by the first roller is altered based on the moisture level of the partially dried inkjet media received from the dryer zone.

7. The system of claim 6, wherein dryer zone is prevented from lowering the moisture level below the second moisture level threshold level.

8. The system of claim 6, wherein a speed of the conditioner is altered based on the moisture level of the partially dried inkjet media received by the dryer zone.

9. The system of claim 6, wherein the dryer zone is coupled between a print zone and the conditioner to affix an image to the partially dried inkjet media generated by the printing fluid.

10. The system of claim 6, wherein the dryer zone lowers the moisture level to a level between the first moisture threshold level and the second moisture threshold level.

11. A system for a partially dried inkjet media conditioner, comprising:

a dryer zone to receive partially dried inkjet media from a print zone of a printing device, wherein the dryer zone includes a dryer zone roller to move the partially dried inkjet media through the dryer zone;

a first heated pressure roller to receive the partially dried inkjet media from the dryer zone; and a second heated pressure roller coupled to an output of the first heated pressure roller to receive the partially dried inkjet media from the first heated pressure roller, wherein a speed of the second heated pressure roller is altered based on a moisture level of the partially dried inkjet media received at the second heated pressure roller.

12. The system of claim 11, wherein a speed of the first heated pressure roller is altered based on a moisture level of the partially dried inkjet media received at the first heated pressure roller.

13. The system of claim 11, wherein a quantity of heat applied by the first heated pressure roller and the second heated pressure roller are altered based on a moisture level of the partially dried inkjet media.

14. The system of claim 11, wherein the speed of the dryer zone roller and the second heated pressure roller are altered to apply tension to the partially dried inkjet media.

* * * * *